United States Patent [19]

Rahn

[11] 4,040,761

[45] Aug. 9, 1977

[54] PIGGYBACK TRACTOR POWERED ROLLER

[76] Inventor: LeRoy W. Rahn, Rte. 2, Box 181 A, Waupun, Wis. 53963

[21] Appl. No.: 744,328

[22] Filed: Nov. 23, 1976

[51] Int. Cl.[2] ..... E01C 19/23

[52] U.S. Cl. ..... 404/86; 404/128; 180/1 C

[58] Field of Search ..... 404/85, 86, 122, 128; 180/1 C; 214/334

[56] References Cited

U.S. PATENT DOCUMENTS

| | | | |
|---|---|---|---|
| 1,348,324 | 8/1920 | Scully | 180/1 C |
| 3,306,175 | 2/1967 | Ferwerda | 404/86 |

FOREIGN PATENT DOCUMENTS

| | | | |
|---|---|---|---|
| 562,316 | 6/1944 | United Kingdom | 404/128 |

*Primary Examiner*—Henry S. Jaudon

*Attorney, Agent, or Firm*—Clarence A. O'Brien; Harvey B. Jacobson

[57] ABSTRACT

A roller chassis including front and rear ends is provided and a rear horizontal transverse roller is journalled from the rear end of the chassis. A front roller support is dependingly supported from the front end of the chassis for oscillation about a vertical axis and a front horizontal roller is journalled from the roller support. The chassis includes opposite side longitudinally extending wheel ramp portions projecting forwardly from the rear roller and which are adapted to support the front wheels of a lawn tractor driven forwardly therealong. The chassis includes a rear portion for anchoring the rear end of a lawn tractor to the roller chassis with the rear driving wheels of the lawn tractor supported from and disposed in driving frictional engagement with the upper peripheral portion of the rear horizontal roller of the chassis. In addition, the front roller support includes an upstanding steering shaft including a generally horizontal and rearwardly projecting steering tiller arm spaced above the chassis a sufficient distance to receive therebeneath the forward end of a lawn tractor having its front wheels support from the ramp portions.

8 Claims, 6 Drawing Figures

PIGGYBACK TRACTOR POWERED ROLLER

BACKGROUND OF THE INVENTION

Various forms of devices have been heretofore provided for powering a lawn roller. Some of these previous devices include roller structures for chassises from which prime movers may be supported and others include conventional farm or lawn tractors from which vertically shiftable rollers are supported.

However, a need exists for an apparatus which may be utilized to readily convert a light weight farm tractor into a lawn roller and which may be readily maneuvered over lawns to be rolled.

Examples of various forms of vehicles equipped with rollers and vehicles including drive wheels which are drivingly coupled to accessory ground engageable wheels or rollers are disclosed in U.S. Pat. Nos. 1,202,365, 1,336,653, 2,309,198, 2,754,602, 2,830,511, 3,665,823 and 3,905,716.

BRIEF DESCRIPTION OF THE INVENTION

The roller of the instant invention includes a roller chassis having front and rear rollers with the front roller supported for oscillation about a vertical axis. The chassis of the roller includes opposite side portions for supporting and along which the front wheels of a farm tractor may be moved and structure is additionally provided whereby a farm tractor having its front wheels supported from the chassis may have its rear wheels disposed in frictionally driving contact with the upper peripheral portion of the rear roller of the chassis. Various structures are provided for anchoring the lawn tractor in position on the roller with the rear wheels of the tractor drivingly engaged with the upper periphery of the rear roller of the chassis and the front roller of the chassis is provided with a rearwardly projecting tiller arm for steering the front roller.

The main object of this invention is to provide an apparatus whereby a reasonably heavy lawn roller may be provided for use in conjunction with a light weight farm tractor and which may be readily steered independently of the steering mechanism of the associated lawn tractor.

Another object of this invention, in accordance with the immediately preceding object, is to provide a lawn roller chassis including structure whereby a conventional form of lawn tractor may be readily anchored in position thereon.

Yet another object of this invention is to provide a lawn roller constructed in a manner whereby the front end of a conventional form of lawn tractor may be readily driven up onto the chassis of the roller for proper positioning thereon and driving engagement of the rear driving wheels of lawn tractor with the upper peripheral portion of the rear roller of the roller chassis.

A final object of this invention to be specifically enumerated herein is to provide a lawn roller in accordance with the preceding objects and which will conform to conventional forms of manufacture, be of simple construction and easy to use so as to provide a device that will be economically feasible, longlasting and relatively trouble-free in operation.

These together with other objects and advantages which will become subsequently apparent reside in the details of construction and operation as more fully described and claimed, reference being had to the accompanying drawings forming a part hereof, wherein like numerals refer to like parts throughout.

DETAILED DESCRIPTION OF THE INVENTION

Figure 1:
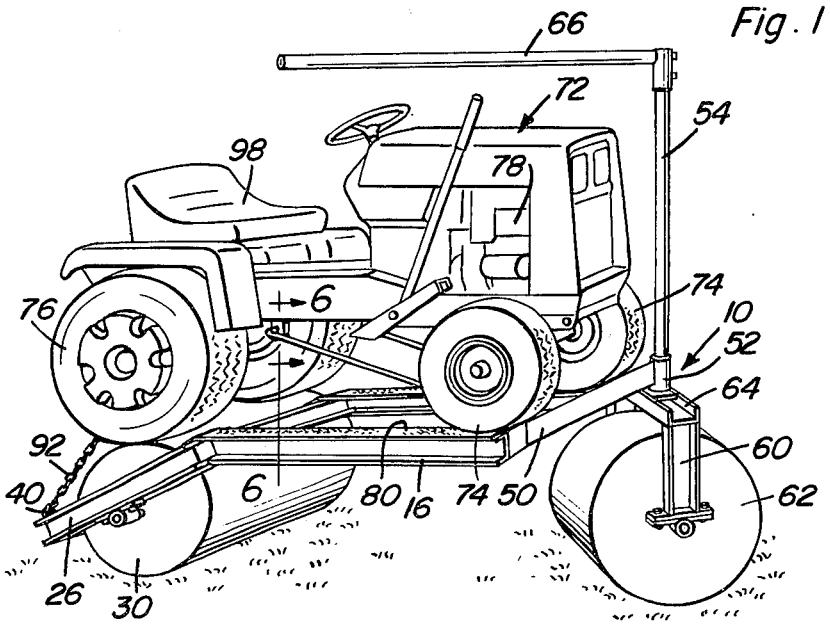
FIG. 1 is a perspective view of the lawn roller of the instant invention with a conventional form of lawn tractor supported therefrom for the purpose of howering the lawn roller.
Figure 6:
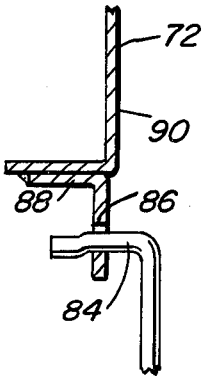
FIG. 6 is a fragmentary enlarged transverse vertical sectional view taken substantially upon the plan indicated by the section line 6—6 of FIG. 1.
Figure 2:
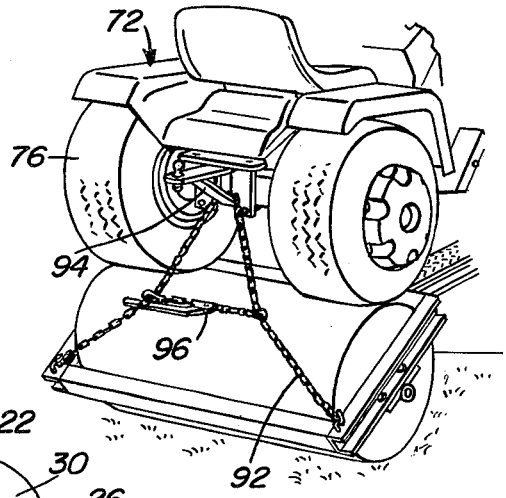
FIG. 2 is a fragmentary rear perspective view of the assemblage illustrated in FIG. 1.
Figure 3:
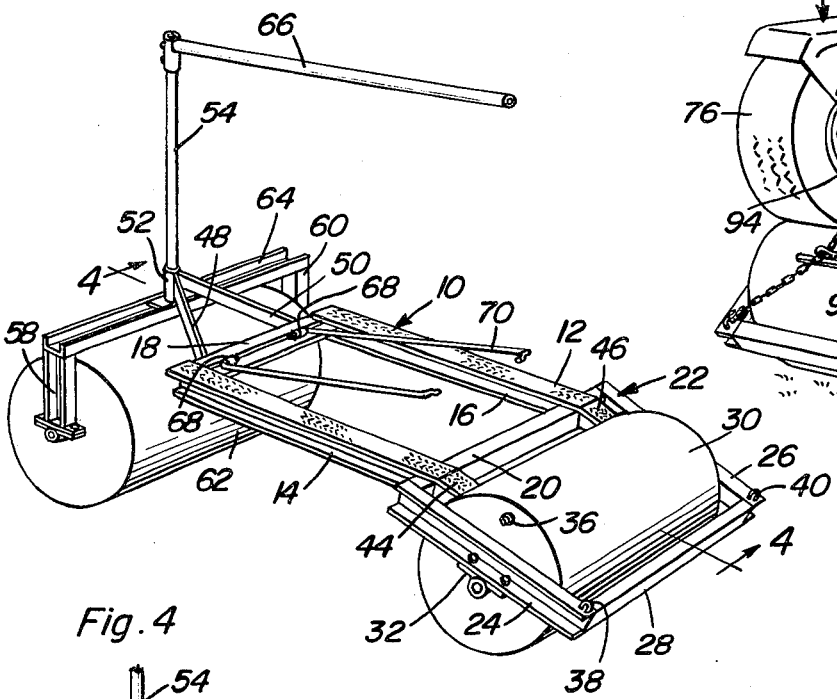
FIG. 3 is a perspective view of the roller chassis with the lawn tractor removed.
Figure 4:
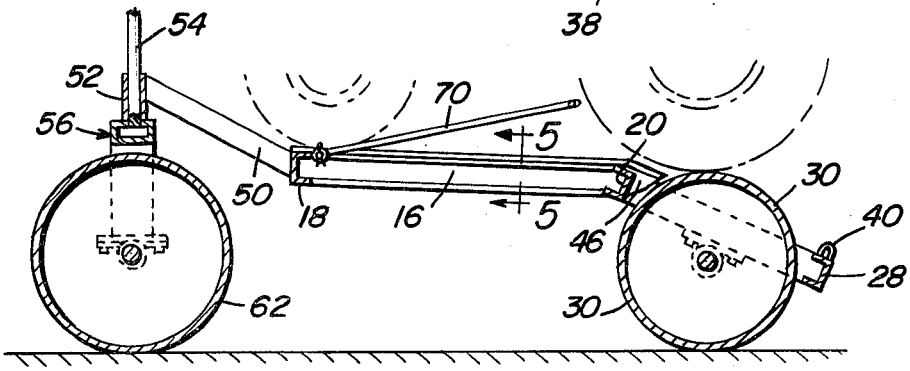
FIG. 4 is a fragmentary longitudinal vertical sectional view taken substantially upon the plan indicated by the section line 4—4 of FIG. 3 and with the lower portion of the associated lawn tractor illustrated in phantom lines.
Figure 5:
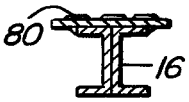
FIG. 5 is a fragmentary enlarged transverse vertical sectional view taken substantially upon the plan indicated by the section line 5—5 of FIG. 4.

Referring now more specifically to the drawings numeral 10 generally designates the lawn roller of the instant invention. The roller 10 includes a rigid frame 12 including opposite side longitudinal members 14 and 16 interconnected at their forward ends by means of a horizontal transverse frame member 18.

The rear ends of the longitudinal members 14 and 16 are interconnected by means of a rear transverse member 20 and the opposite ends of the rear transverse member 20 project outwardly beyond the remote sides of the members 14 and 16 and the transverse member 20 defines the forward transverse member of a rearwardly and downwardly inclined rectangular frame referred to in general by the reference numeral 22 including opposite side members 24 and 26 projecting rearwardly from the ends of the transverse member 20 and interconnected at their rear ends by means of a transverse member 28.

A rear roller 30 is journalled from journal blocks 32 secured to the underside portions of the longitudinal portions of the frame members 24 and 26 and the roller 30 is hollow and fluid-tight. One end of the roller 30 includes a removable plug 36 by which the interior of the roller 30 may be filled with a liquid in order to increase the weight of the roller 30.

The rear ends of the members 24 and 26 include anchor members 38 and 40 and short bridging members 44 and 46 project slightly rearwardly of and are supported from the opposite ends of the transverse member 20 in alignment with members 14 and 16. The bridging members 44 and 46 project rearwardly from the transverse member 20 and terminate a spaced distance forwardly of the roller 30.

A pair of forwardly convergent and upwardly inclined bracing arms 48 and 50 have their rear lower ends secured to opposite end portions of the transverse member 18 and the forward ends of the bracing arms 48 and 50 are secured together and to a vertical journal sleeve 52 which rotatably journals the lower end of a steering shaft 54 which extends downwardly through the sleeve 52 and is anchored to the mid-portion of an inverted U-shaped front roller support referred to in general by the reference numeral 56. The front roller support 56 includes a pair of depending opposite side legs 58 and 60 between whoselower ends a front horizontal roller 62 corresponding to the roller 30 is journalled and the upper ends of the legs 58 and 60 are interconnected by means of a rigid horizontal bight portion 64 extending and secured therebetween, the lower end of the steering shaft 54 being anchored to the mid-portion of the bite portion 64.

The upper end of the steering shaft 54 has the forward end of a horizontally disposed and rearwardly projecting tiller arm 66 supported therefrom and it will be noted that the rear end of the tiller arm 66 extends rearwardly to a point spaced generally vertically above the rear transverse member 20.

The foreard transverse member 18 has a pair of small diameter journal sleeves 68 anchored thereto and the forward lower ends of a pair of rearwardly and upwardly inclined bracing rods 70 are journalled through the sleeves 68.

A conventional form of lawn tractor is generally referred to by the reference numeral 72 and includes front steerable wheels 74 and rear driving wheels 76. The tractor 72 includes a motor 78 which is drivingly coupled to the rear wheels 76 through a clutch and multi-speed transmission including a reverse gear.

The longitudinal members 14 and 16 have wheel ramp plates 80 secured to the upper surfacrs thereof and the bridging members 44 and 46 are provided with similar plates. The tractor 72 may be driven up onto the chassis comprising the roller 10 with the front wheels of the tractor resting upon the wheel ramp plates 80 and the rear wheels 76 of the tractor 72 resting upon the upper periphery of the rear roller 30. Thereafter, the rear upper ends of the rods or bars 70 may have their laterally directed ends 84 passed through transfers bores 86 formed in anchor plates 88 secured to and depending downwardly from the opposite side longitudinal frame members 90 of the tractor 72. Still further, the opposite ends of a length of chain 92 may have the hooks thereon engaged with the anchors 40 with the mid-portion of the chain 92 passed over the rear tow hitch 94 of the tractor 72. Thereafter, a tensioning apparatus 96 may be e ngaged between the two reaches of the chain 92 extending between the tow hitch 94 and the anchors 40 in order to tension the chain 92. With the tractor 72 thus positioned on the chassis or roller 10 and the chain 92 tensioned in order to pull the rear wheels 76 of the tractor 72 down into tight frictional engagement with the upper peripheral portion of the roller 30, the engine 78 of the tractor 72 may be started and the transmission may be placed in gear in order that the rear wheels 76 of the tractor 72 may drive the rear roller 30. Of course, the tiller arm 66 projects rearwardly over the front end of the tractor 72 to a position closely adjacent the driver's position 98 of the tractor 72. Thus, a person seated in the driver's position 98 on the tractor 72 may readily steer the front roller 62 of the chassis 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a roller chassis including front and rear ends, a rear horizontal transverse roller journalled from the rear end of said chassis, a front roller support dependingly supported from the front end of said chassis for oscillation about a vertical axis, a front horizontal roller journalled from said roller support, said chassis including opposite side longitudinally extending wheel ramp portions projecting forwardly from said rear roller adapted to support the front wheels of a lawn tractor rolled forwardly therealong, said chassis including a rear portion adapted to have one portion of tractor anchoring structure anchored thereto, said front roller support including a central upwardly projecting steering shaft including a generally horizontal rearwardly projecting steering tiller arm spaced above said chassis sufficiently to receive therebeneath the forward end of a lawn tractor having its front wheels supported from said wheel ramp portions, said tiller arm projecting rearwardlyfrom said steering shaft a distance sufficient to extend to the operator's position of said lawn tractor.

2. The combination of claim 1 wherein said chassis includes front and rear extending inclined bracing bars whose lower ends are anchored relative to said chassis and whose upper ends including attaching means adapted for removable attachment to opposite side frame portions of said lawn tractor.

3. The combination of claim 1 wherein the lower ends of said bars comprise the forward ends thereof.

4. The combination of claim 1 wherein said lower ends of said bars and said chassis include means pivotally anchoring said lower ends to said chassis for angular displacement relative thereto about horizontal axes extending transversely of said chassis.

5. The combination of claim 1 including a four wheeled lawn tractor having front steerable wheels and rear driving wheels and supported from said chassis with the front wheels of said tractor disposed on said ramp portions and the rear driving wheels of said tractor resting upon the upper periphery of said rear roller in driving frictional engagement therewith, means anchoring the rear of said tractor to said rear portion of said tractor to said rear portion of said chassis, said tractor including an operator's position, said tiller arm projecting rearwardly over the front of said tractor to a position adjacent said drivers position.

6. The combination of claim 5 wherein said chassis includes front and rear extending inclined bracing bars whose lower ends are anchored relative to said chassis and whose upper ends including attaching means adapted for removable attachment to opposite side frame portions of said lawn tractor and are removably anchored to said chassis.

7. The combination of claim 6 wherein the lower ends of said bars comprise the forward ends thereof.

8. The combination of claim 7 wherein said lower ends of said bars and said chassis include means pivotally anchoring said lower ends to said chassis for angular displacement relative thereto about horizontal axes extending transversely of said chassis.

* * * * *